US008873346B2

(12) United States Patent
Correa et al.

(10) Patent No.: US 8,873,346 B2
(45) Date of Patent: Oct. 28, 2014

(54) WATCH DIAL SECURED TO A BOTTOM PLATE

(71) Applicant: ETA SA Manufacture Horlogere Suisse, Grenchen (CH)

(72) Inventors: David Correa, Bienne (CH); Yvan Ferri, Lausanne (CH); Stephane Rychen, Bern (CH); Roger Willemin, Grenchen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 13/937,767

(22) Filed: Jul. 9, 2013

(65) Prior Publication Data

US 2014/0016446 A1 Jan. 16, 2014

(30) Foreign Application Priority Data

Jul. 12, 2012 (EP) ..... 12176187

(51) Int. Cl.
*G04B 19/06* (2006.01)
*G04B 19/14* (2006.01)

(52) U.S. Cl.
CPC ..... *G04B 19/14* (2013.01)
USPC ..... 368/232

(58) Field of Classification Search
CPC ..... G04B 19/14; G04B 19/06; G04B 19/12; G04B 19/10; G04B 19/065; G04D 3/0048
USPC ..... 368/232, 88, 276, 294–296, 314, 228, 368/236
See application file for complete search history.

(56) References Cited

U.S. PATENT DOCUMENTS

| | | | | |
|---|---|---|---|---|
| 1,886,166 | A * | 11/1932 | Colomb | 368/236 |
| 4,184,317 | A * | 1/1980 | Kanda et al. | 368/300 |
| 4,207,735 | A * | 6/1980 | Ishigaki et al. | 368/300 |
| 6,456,569 | B1 | 9/2002 | Stauffer | |
| 6,575,619 | B1 * | 6/2003 | Stauffer | 368/299 |

FOREIGN PATENT DOCUMENTS

| | | |
|---|---|---|
| CH | 27050 | 12/1903 |
| CH | 30614 | 1/1905 |
| CH | 289105 | 2/1953 |
| CH | 367759 | 11/1962 |

(Continued)

OTHER PUBLICATIONS

European Search Report issued Jan. 31, 2013, in European Application No. 12176187.8 filed Jul. 12, 2012 (with English Translation).

*Primary Examiner* — Edwin A Leon
(74) *Attorney, Agent, or Firm* — Oblon, Spivak, McClelland, Maier & Neustadt, L.L.P.

(57) ABSTRACT

An assembly including a watch dial and a bottom plate, the bottom plate being delimited by an upper peripheral rim which is extended downwards by an external peripheral surface, the watch dial being secured to the upper peripheral rim of the bottom plate via at least first and second securing mechanisms, wherein the first securing mechanisms includes a boss provided on the external peripheral surface of the bottom plate, the dial having a peripheral edge via which the dial is held between the head of a nail or a screw and the upper peripheral rim of the bottom plate, the head of the nail or screw being extended by a shank which is housed in the boss of the bottom plate.

13 Claims, 5 Drawing Sheets

(56) References Cited

FOREIGN PATENT DOCUMENTS

| | | |
|---|---|---|
| CH | 471 714 | 4/1969 |
| CH | 704 125 A2 | 5/2012 |
| DE | 540 671 | 12/1931 |
| DE | 7030823 | 11/1970 |
| DE | 2 301 145 | 6/1973 |
| EP | 1 046 968 A1 | 10/2000 |

* cited by examiner

WATCH DIAL SECURED TO A BOTTOM PLATE

CROSS-REFERENCE TO RELATED APPLICATION

This application claims priority from European Patent Application No. 12176187.8 filed Dec. 7, 2012, the entire disclosure of which is incorporated herein by reference.

BACKGROUND OF THE INVENTION

1. Field of the Invention

The present invention concerns a watch dial secured to a bottom plate. More specifically, the invention concerns a watch dial secured to a bottom plate via securing means.

2. Discussion of the Background

The technique conventionally used to hold a watch dial on a bottom plate consists in providing the dial with dial feet which are locked by means of corresponding dial keys. One of the drawbacks of this technique is that the dial feet are fragile and they can easily break in the event of a shock. Since the dial feet themselves cannot be repaired, the entire dial has to be replaced, provided that it is still available as a spare part, which is not always the case.

SUMMARY OF THE INVENTION

It is an object of the present invention to overcome the aforementioned drawbacks in addition to others by providing a watch dial secured to a bottom plate via a new securing means which is both simple and reliable.

The present invention therefore concerns an assembly comprising a watch dial and a bottom plate, the bottom plate being delimited by an upper peripheral rim which is extended downwards by an external peripheral surface, the watch dial being secured to the upper peripheral rim of the bottom plate via at least first and second securing means, said assembly being characterized in that the first securing means comprises a boss provided on the external periphery of the bottom plate, the dial having a peripheral edge via which the dial is held between the head of a nail or a screw and the upper peripheral rim of the bottom plate, the nail or screw head being extended by a shank which is housed in the boss of the bottom plate.

As a result of these features, this invention provides an assembly comprising a watch dial and a bottom plate wherein the peripheral edge of the dial is held between the head of a nail or of a screw and the upper peripheral rim of the bottom plate, the nail or screw head being received in a boss arranged on the external periphery of the bottom plate. The dial is thus immobilised using simple, reliable and very economical means. Where the bottom plate is made of plastic material, the bosses arranged on the external periphery of the bottom plate can be obtained very simply by plastic moulding or injection moulding.

According to a first variant of the invention, the second securing means includes a slot provided on the upper peripheral rim of the bottom plate, with the dial being housed via its peripheral edge in the slot in the bottom plate.

According to a second variant, the second securing means includes a second boss provided on the external periphery of the bottom plate, the head of a second nail or of a second screw holding the peripheral edge of the dial against the upper peripheral rim of the bottom plate, the head of the second nail or of the second screw being extended by a shank which is housed in the second boss of the bottom plate.

According to a complementary feature of the invention, the dial is disposed between a flange and the bottom plate, the nail or the screw being driven or screwed into the flange and sandwiching the flange between its head and shank which is housed in the boss of the bottom plate.

According to yet another feature of the invention, the upper peripheral rim of the bottom plate includes at least one centring stud and the peripheral edge of the dial includes a notch arranged to cooperate with the centring stud.

BRIEF DESCRIPTION OF THE DRAWINGS

Other features of the present invention will appear more clearly from the following detailed description of one embodiment of the dial and the bottom plate according to the invention, this example being given solely by way of non-limiting illustration with reference to the annexed drawing, in which.

DETAILED DESCRIPTION OF THE PREFERRED EMBODIMENTS

The present invention proceeds from the general inventive idea which consists in using nails or screws to secure a watch dial to a bottom plate. This securing means is both a simple and thus economical means and immobilises the dial in a perfectly reliable manner. According to another advantage of the invention, the dial does not need to be modified since it is simply held between the head of the nail or of the screw and the upper peripheral rim of the bottom plate. The only particular arrangement concerns the bottom plate which must be provided with as many bosses on its external periphery as there are screw heads. This does not however cause any significant problem, in particular where the bottom plate is made of an injected or moulded plastic material. Indeed, in this case the mould simply needs to be provided with recesses matching the bosses.

Figure 1:
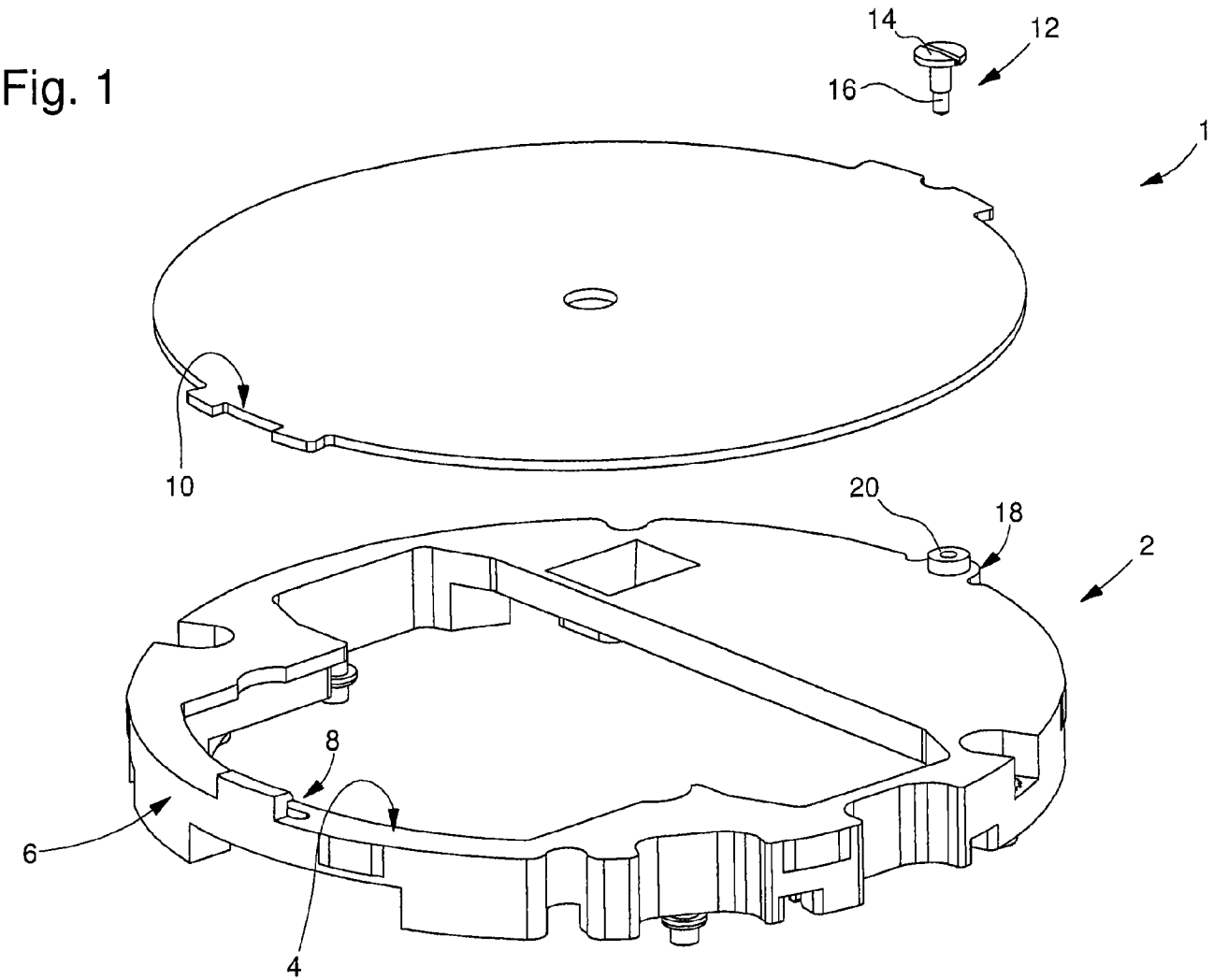
FIG. 1 is a perspective view of a first embodiment of the invention wherein the dial is held at a first point in a slot arranged in the bottom plate and at a second point by a screw.
Figure 2:
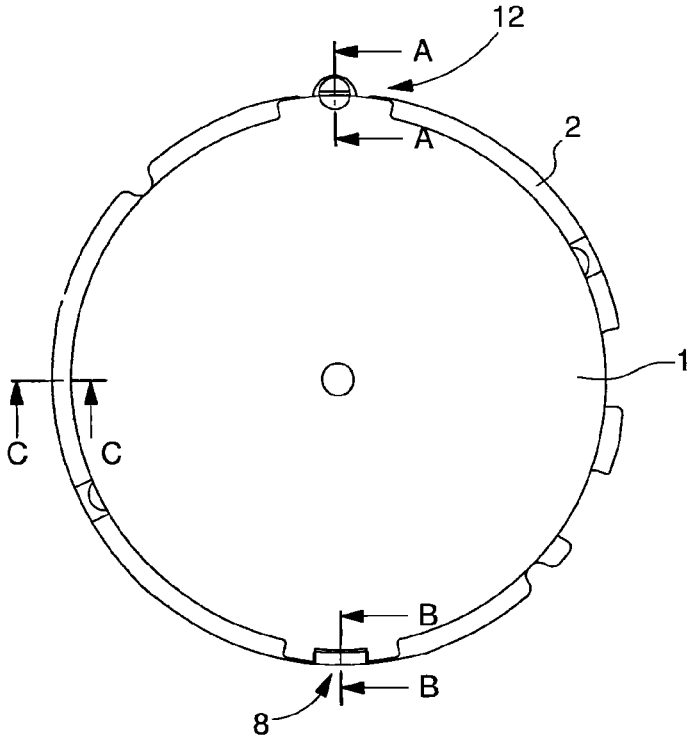
FIG. 2 is a top view of the assembly formed by the dial and the bottom plate illustrated in FIG. 1.
Figure 3A:
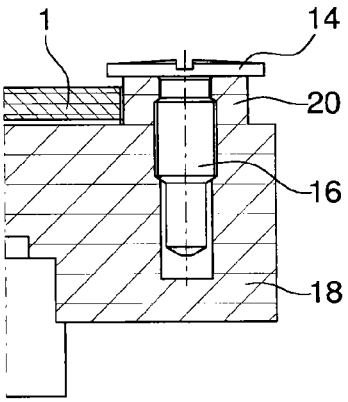
FIGS. 3A, 3B and 3C are cross-sections along lines AA, B-B and C-C of FIG. 2.
Figure 3B:
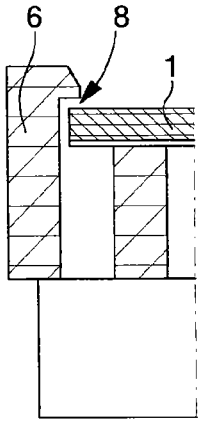
Figure 3C:
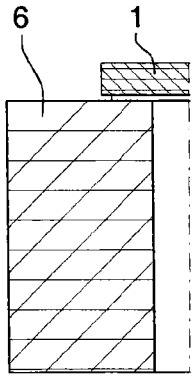

A first embodiment of the invention is illustrated in FIGS. 1 to 3. Designated as a whole by the general reference numeral 1, the dial is obtained for example from a metal sheet or a plastic sheet. In the example of FIG. 1, both dial 1 and bottom plate 2 are of generally circular shape. It will be clear however that the invention is not limited to this geometry and that dial 1 and bottom plate 2 may have any shape, such as, for example, square or rectangular.

Bottom plate 2 generally takes the form of a ring. It is delimited at the top by a circular peripheral rim 4 on which dial 1 will be supported and which is extended towards the bottom by an external peripheral surface 6.

As can be seen by examining FIG. 1, on one location on the length of upper peripheral rim 4, bottom plate 2 is provided with a slot 8 in the arc of a circle into which peripheral edge 10 of dial 1 slides. Slot 8 thus provides a first holding point along the vertical direction where dial 1 is held on bottom plate 2.

According to the invention, dial 1 is held on bottom plate 2 on at least a second point. Therefore, a screw 12 is used which includes a head 14 extended by a shank 16. Dial 1 will now be held at one location on the peripheral edge 10 thereof between head 14 of screw 12 and the upper peripheral rim 4 of bottom plate 2. Screw 12 thus provides a second holding point where dial 1 is held on bottom plate 2 both in a vertical direction perpendicular to the plane of dial 1 and in a radial direction. To hold screw 12, a corresponding boss 18, into which the shank 16 of screw 12 is screwed, is provided on the external peripheral surface 6 of bottom plate 2. Boss 18 is formed by an excess of material, which is provided locally on the external peripheral surface 6 of bottom plate 2 and is sufficient to enable screw 12 to be screwed therein. Where bottom plate 2 is made of a plastic material, boss 18 may be obtained very simply by plastic moulding or injection moulding. In the example shown in the drawing, a centring pin 20 is provided on boss 18. This centring pin 20, against which dial 1 abuts via the peripheral edge 10 thereof, rises up at the surface of upper peripheral rim 4 of bottom plate 2 and is provided to improve the guiding of screw 12. As is seen more particularly in FIG. 2, screw 12 is provided at twelve o'clock and slot 8 is provided at six o'clock. Screw 12 and slot 8 hold dial 1 perfectly on bottom plate 2, so that no other holding means is necessary. For example, at nine o'clock (see FIG. 3C), dial 1 simply abuts on bottom plate 2.

In the above description, there is only one boss 18, intended to act as a seat for a corresponding screw 12. It goes without saying that the invention is not limited to this example embodiment and that several bosses and corresponding screws may be provided. Likewise, dial 1 was described as being secured by means of one or several screws. It is clear that these screws may be replaced by other securing means, such as nails, which will be driven into the bosses.

Figure 4:
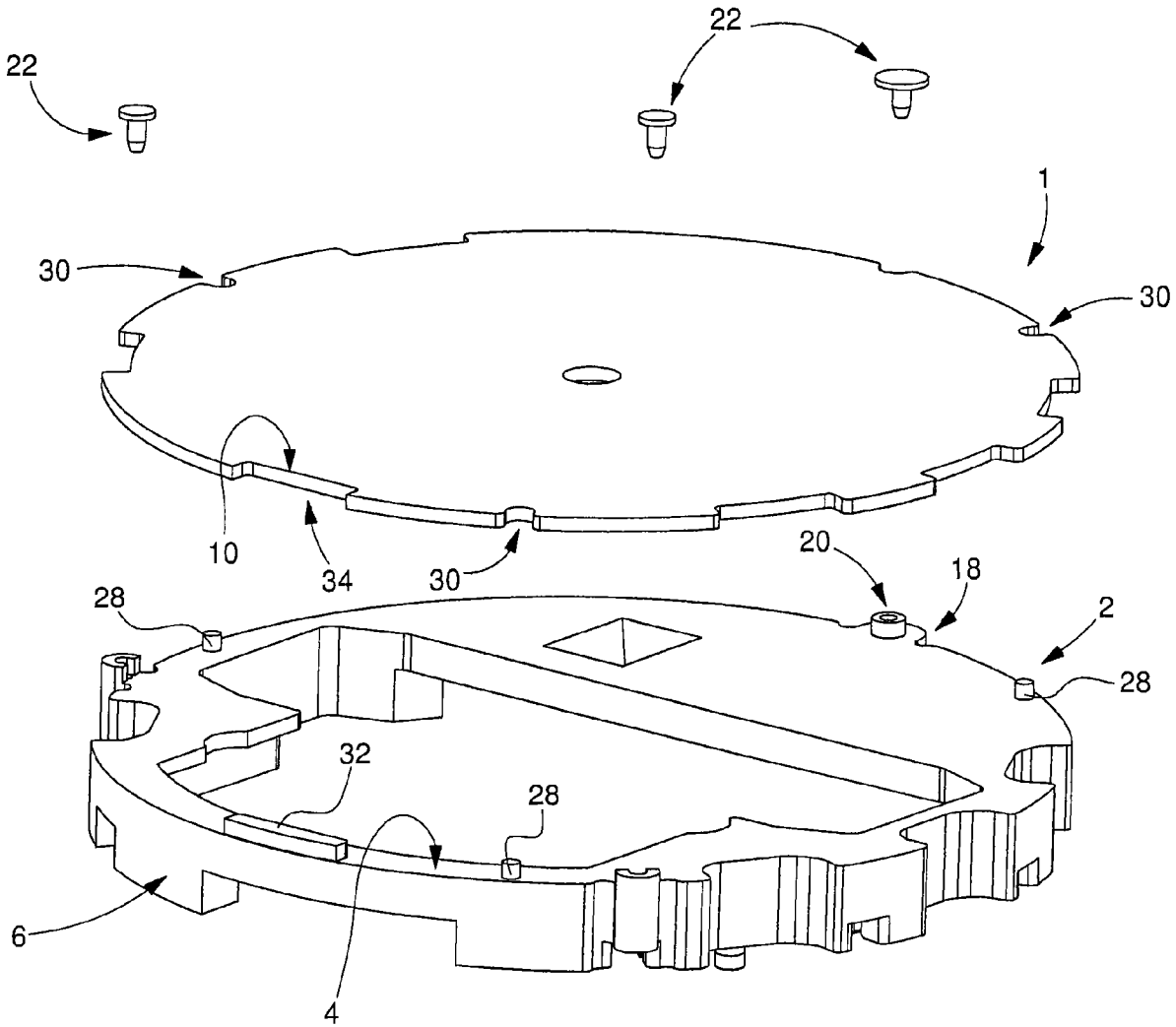
FIG. 4 is a perspective view of a second embodiment of the invention wherein the peripheral edge of the dial is held between the head of three nails and the upper peripheral rim of the bottom plate, the shanks of the nails being received in a boss arranged on the external periphery of the bottom plate.
Figure 5:
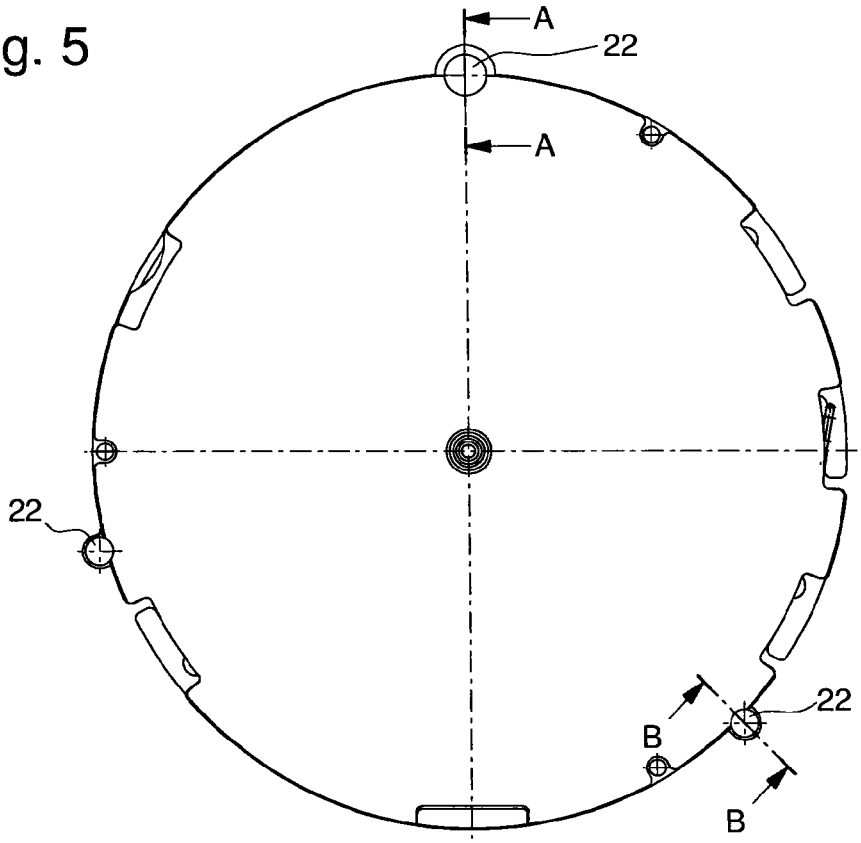
FIG. 5 is a top view of the assembly formed by the dial and the bottom plate illustrated in FIG. 4.
Figure 6A:
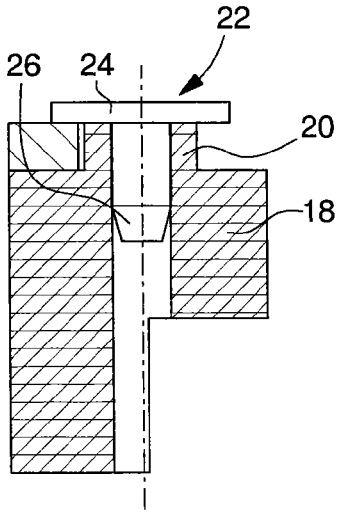
FIGS. 6A and 6B are cross-sections along lines A-A and B-B of FIG. 5.
Figure 6B:
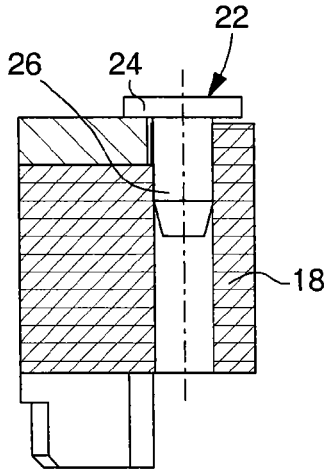

FIG. 4 illustrates a variant of the invention wherein dial 1 is secured to bottom plate 2 by means of at least two nails 22, or three in the example shown. The corresponding bosses 18 are provided on the external peripheral surface 6 of bottom plate 2, for example at regularly spaced intervals from each other. Nail 22 provided at twelve o'clock (FIG. 6A) has a larger head 24 than the nail 22 provided at four o'clock (FIG. 6B), the head of these nails being extended by a shank 26.

To further improve the orientation of dial 1, bottom plate 2 includes at least one centring stud 28 on upper peripheral rim 4 and the peripheral edge 10 of dial 1 includes a notch 30 arranged to cooperate with centring stud 28. Finally, to orient dial 1 in a suitable manner, a mistake-proofing element, such as a lug 32, which is provided on the upper peripheral rim 4 of bottom plate 2, for example at six o'clock, is housed in a corresponding housing 34 arranged on peripheral edge 10 of dial 1.

Figure 7:
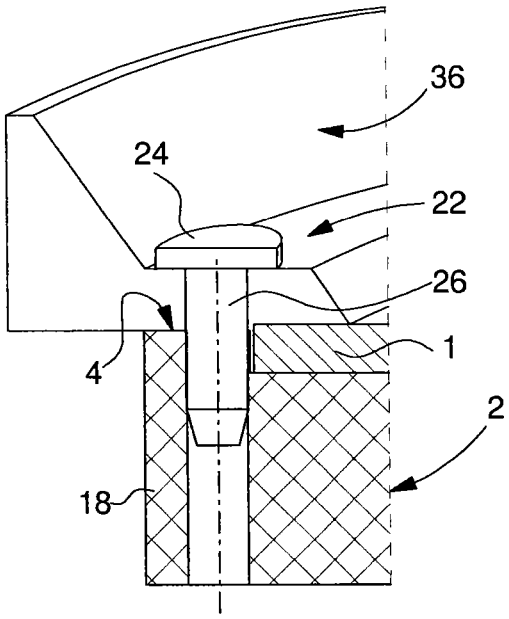
FIG. 7 is a schematic, perspective view of a third embodiment of the invention wherein the dial is disposed between a flange and the upper peripheral rim of the bottom plate, with the nails being driven into the flange and sandwiching the flange between their heads and shanks which are housed in corresponding bosses of the bottom plate.

FIG. 7 illustrates another variant wherein dial 1 is sandwiched between a flange 36 and upper peripheral rim 4 of bottom plate 2. To hold the assembly formed by flange 36, dial 1 and bottom plate 2, nails 22 are driven into flange 36, the shank 26 of these nails 22 being housed in corresponding bosses 18 provided on the external peripheral surface 6 of bottom plate 2. Flange 36 is thus held between head 24 of nails 22 and upper peripheral rim 4 of dial 1 and grips dial 1. Instead of the nails, screws could be provided which are screwed into flange 36 and into bosses 18 of bottom plate 2.

Figure 8:
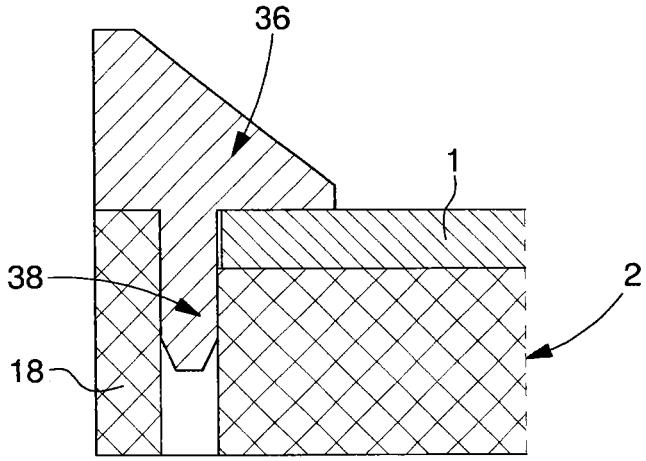
FIG. 8 is a schematic view of a variant of the invention wherein a securing foot, which is integral with the flange and which is housed in the corresponding boss of the bottom plate, sandwiches the dial between the flange and the bottom plate.

FIG. 8 illustrates another variant of the invention wherein a securing foot 38, which is integral with flange 36 and which is housed in the corresponding boss 18 of bottom plate 2, sandwiches dial 1 between flange 36 and bottom plate 2.

What is claimed is:

1. An assembly comprising a watch dial and a bottom plate, wherein the bottom plate is delimited by an upper peripheral rim which is extended downwards by an external peripheral surface, wherein the watch dial is secured to the upper peripheral rim of the bottom plate via at least first and second securing means, wherein the first securing means comprises a boss provided on the external peripheral surface of the bottom plate, wherein the dial has a peripheral edge via which the dial is held between the head of a nail or a screw and the upper peripheral rim of the bottom plate, wherein the head of the nail or screw is extended by a shank which is housed in the boss of the bottom plate.

2. The assembly according to claim 1, wherein the second securing means includes a slot provided on the upper peripheral rim of the bottom plate, and wherein the peripheral edge of the dial is housed in the slot of the bottom plate.

3. The assembly according to claim 1, wherein the second securing means includes a second boss provided on the external peripheral surface of the bottom plate, wherein a second nail or a second screw holds, via the head thereof, the peripheral edge of the dial against the upper peripheral rim of the bottom plate, wherein the head of the second nail or of the second screw is extended by a shank which is housed in the second boss of the bottom plate.

4. The assembly according to claim 1, wherein the dial is disposed between a flange and the bottom plate, wherein the nail or the screw is driven or screwed into the flange and sandwiches the flange between the head and the shank thereof which is housed in the boss of the bottom plate.

5. The assembly according to claim 2, wherein the dial is disposed between a flange and the bottom plate, wherein the nail or the screw is driven or screwed into the flange and sandwiches the flange between the head and the shank thereof which is housed in the boss of the bottom plate.

6. The assembly according to claim 3, wherein the dial is disposed between a flange and the bottom plate, wherein the nail or the screw is driven or screwed into the flange and sandwiches the flange between the head and the shank thereof which is housed in the boss of the bottom plate.

7. The assembly according to claim 1, wherein the dial is disposed between a flange and the bottom plate, wherein at least one securing foot, which is integral with the flange, is housed in the corresponding boss of the bottom plate.

8. The assembly according to claim 2, wherein the dial is disposed between a flange and the bottom plate, wherein at least one securing foot, which is integral with the flange, is housed in the corresponding boss of the bottom plate.

9. The assembly according to claim 3, wherein the dial is disposed between a flange and the bottom plate, wherein at least one securing foot, which is integral with the flange, is housed in the corresponding boss of the bottom plate.

10. The assembly according to claim 1, wherein the bottom plate includes at least one centring stud on the upper peripheral rim thereof and the peripheral edge of the dial includes a notch arranged to cooperate with the centring stud.

11. The assembly according to claim 1, wherein said peripheral edge of said dial abuts against said shank.

12. The assembly according to claim 1, wherein said dial is free of holes for receiving said shank.

13. The assembly according to claim 11, wherein said head is above a top surface of said dial such that said head protrudes above said top surface of said dial.

* * * * *